US006468151B2

(12) United States Patent
Darcey

(10) Patent No.: US 6,468,151 B2
(45) Date of Patent: Oct. 22, 2002

(54) LOUVER MEMBER AND METHOD

(76) Inventor: Mike E. Darcey, 143 Tarleton Ave., Burlington, NC (US) 27215

( * ) Notice: Subject to any disclaimer, the term of this patent is extended or adjusted under 35 U.S.C. 154(b) by 0 days.

(21) Appl. No.: 09/815,356

(22) Filed: Mar. 22, 2001

(65) Prior Publication Data

US 2001/0024942 A1 Sep. 27, 2001

Related U.S. Application Data

(63) Continuation-in-part of application No. 09/533,193, filed on Mar. 23, 2000, now Pat. No. 6,322,441.

(51) Int. Cl.[7] ..... F24F 7/00
(52) U.S. Cl. ..... 454/277; 52/520; 454/280
(58) Field of Search ..... 454/260, 275, 454/276, 277, 280, 281; 52/520, 543, 314

(56) References Cited

U.S. PATENT DOCUMENTS

| | | | |
|---|---|---|---|
| 140,707 | A | 7/1873 | Hyatt |
| 173,787 | A | 2/1876 | Hayes |
| 313,865 | A | 3/1885 | Hayes |
| 345,689 | A | 7/1886 | Hayes |
| 2,803,185 | A | 8/1957 | Coleman |
| 3,267,834 | A | 8/1966 | Hockett |
| 3,302,554 | A | 2/1967 | Rousey et al. |
| 5,070,771 | A | 12/1991 | Mankowski |
| 5,255,486 | A | 10/1993 | Wang |
| 5,728,000 | A | 3/1998 | Bateman |

*Primary Examiner*—Harold Joyce

(57) ABSTRACT

A louver member is provided for forming louver assemblies for houses and other buildings for ventilation purposes. The method of installing the louver members includes cutting to size and attaching the same to roof trusses for on-site louver assembly. Each louver member has a somewhat inverted V-shape with a front and an apertured rear to allow air passage.

8 Claims, 23 Drawing Sheets

LOUVER MEMBER AND METHOD

This a continuation-in-part of pending patent application Ser. No. 09/533,193 filed Mar. 23, 2000, now U.S. Pat. No. 6,322,441.

FIELD OF THE INVENTION

The invention herein pertains to louvers for ventilating buildings and particularly pertains to elongated preformed louver members used in on-site louver assembly.

DESCRIPTION OF THE PRIOR ART AND OBJECTIVES OF THE INVENTION

Houses, manufactured homes and other buildings require ventilation to prevent excess heat build-up and deterioration of building structures. Builders of houses and mobile home manufacturers often purchase triangle, octagon, square or other slatted louvers formed from wood, plastic, metal and the like. Openings are then framed on-site and the purchased louvers installed. Such louvers often distract from the appearance of a building or mobile home and are distasteful to homeowners and others. For example, a home which is finished with aluminum siding may have an attic louver formed from wood. The wooden louver is effective for ventilation but unsightly and must be constantly maintained with paint or the like to protect it and prevent it from deteriorating. Oftentimes such louvers in houses are difficult to reach due to their height and are left unattended for many years, ultimately having to be completely replaced.

Thus, with the problems and disadvantages of conventional louvers, the present invention was conceived and one of its objectives is to provide a weatherproof louver member which can be cut to size and installed on-site to form a louver assembly.

It is still another objective of the present invention to provide a louver member and method of use which allows flexibility in the size and shape of the louver assembly formed.

It is also an objective of the present invention to provide louver members which are manufactured for on-site delivery and which can be cut and installed using simple hand tools.

It is yet a further objective of the present invention to provide a louver member which is relatively inexpensive to manufacture and can be self-installed by relatively unskilled workers.

It is a further objective of the present invention to provide a louver assembly which blends with the trim of a house or other building and appears as an integral part thereof.

Various other objectives and advantages of the present invention will become apparent to those skilled in the art as a more detailed description is set forth below.

SUMMARY OF THE INVENTION

The aforesaid and other objectives are realized by providing elongated louver members formed from aluminum or other suitable materials which can be delivered to a job-site, cut to the proper size and easily aligned and installed on a building to form, for example, an attic louver. The louver members have a somewhat inverted V-shape with the front extending outwardly from the rear approximately five centimeters. The rear of the louver member includes a series of apertures which allow air to pass into and out of the building attic. In the preferred form of the louver member a bracket is affixed to the rear which acts as a saddle for alignment and abutment with the adjacent louver member during installation.

The method of installation allows the user to cut a first louver member to a desired length using simple hand tools and thereafter to cut succeeding louver members to successively shorter lengths such as in the construction of a triangular louver assembly. Each individual louver member is then attached to a truss or the like with conventional fasteners to form the louver assembly. When completed the louver assembly is difficult to distinguish from conventional siding and does not detract from the building's appearance.

DETAILED DESCRIPTION OF THE PREFERRED EMBODIMENT AND OPERATION OF THE INVENTION

Figure 1:
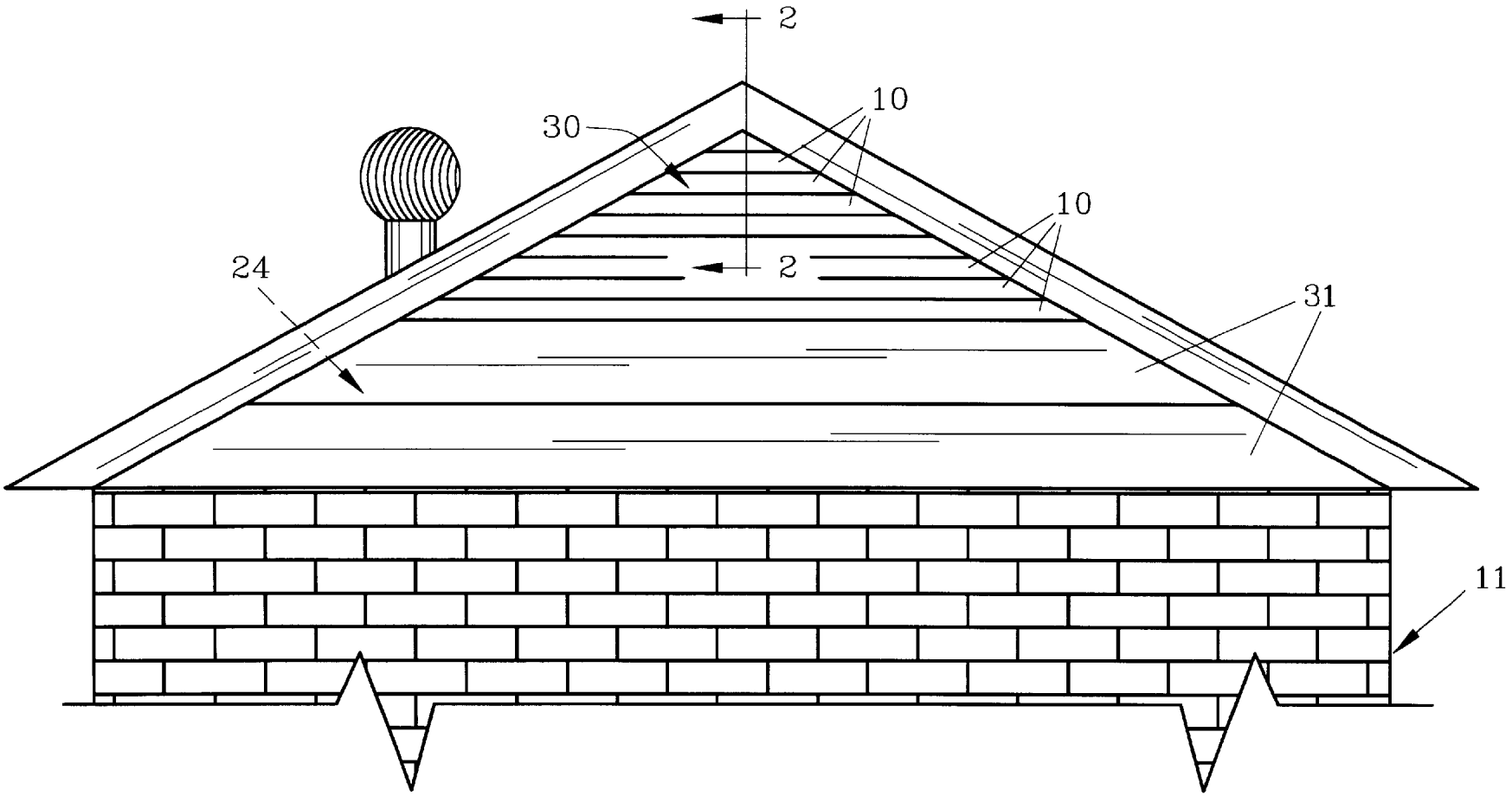
FIG. 1 shows the end of a typical house with the louver members of the invention forming an attic louver assembly.
Figure 2:
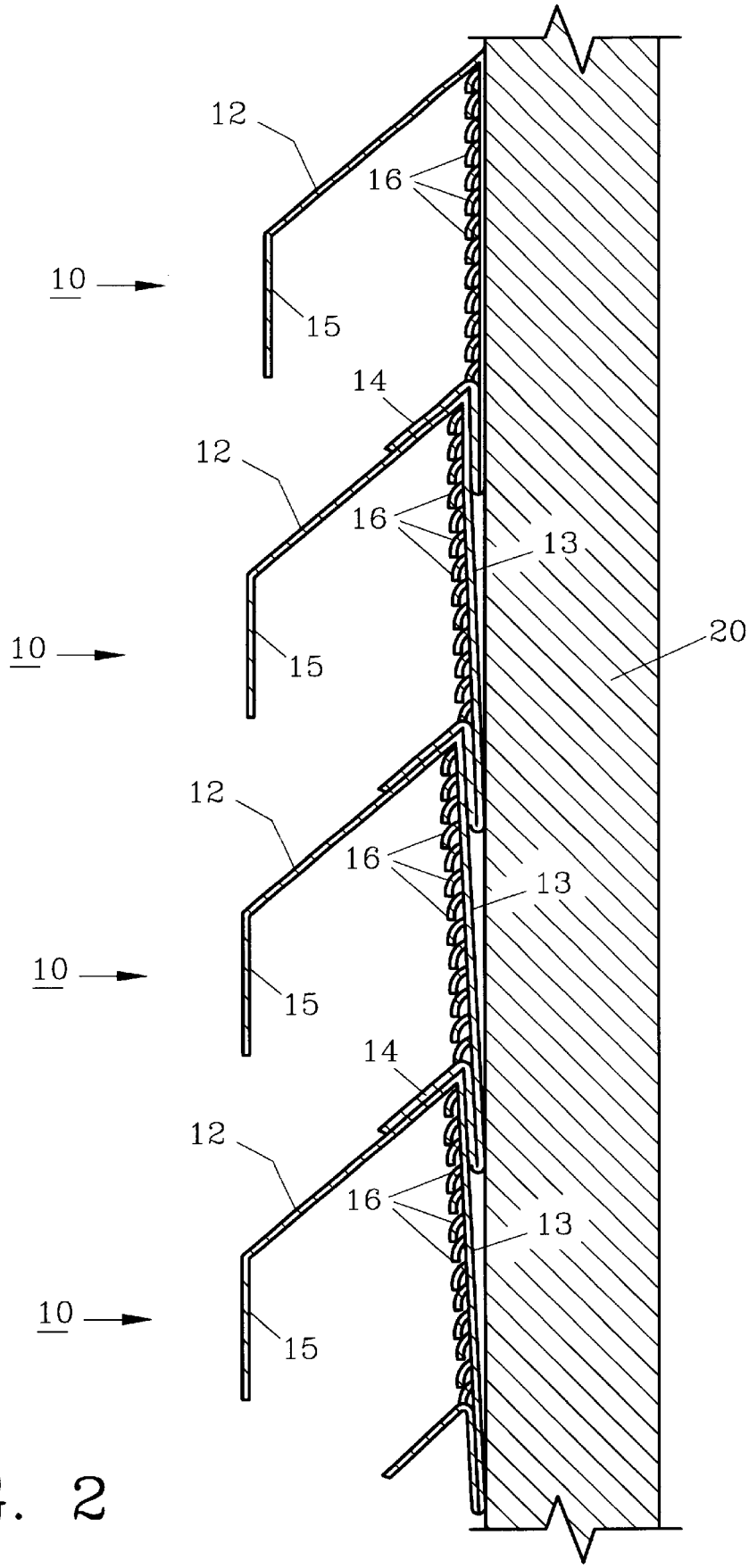
FIG. 2 demonstrates a cross-section view along lines 2—2 of the louver assembly as seen in FIG. 1.

For a more detailed explanation of the invention and its method of use, turning now to the drawings, FIG. 1 demonstrates in schematic form preferred louver members 10 attached to form louver assembly 30 on the end of attic 20 of house 11. Louver members 10 which form louver assembly 30 may be for example, formed preferably such as by extrusion of aluminum in twelve foot (3.66 m) horizontal sections for on-site cutting and installation. Preferably, louver members 10 have a height of approximately 4 inches (10.16 cm). As seen in FIG. 2, louver members 10 have a general inverted V-shape with an elongated front section 12 and an elongated rear section 13 integrally formed such as by conventional extrusion or molding processes. Front section 12 includes a bent or downwardly directed portion 15 near the distal end thereof. Downward directed portion 15 is parallel to rear section 13 and is approximately one-half the length of front section 12. Louver members. 10 are attached to supports such as roof truss member 24 such as by nails, staples, screws or otherwise. Truss member 24 is part of a usual roof truss system formed from wooden two-by-fours or other suitable materials. It should be noted that both the left and right ends of louver assembly 30 would appear identical to the cross-sectional view shown in FIG. 2.

Figure 3:
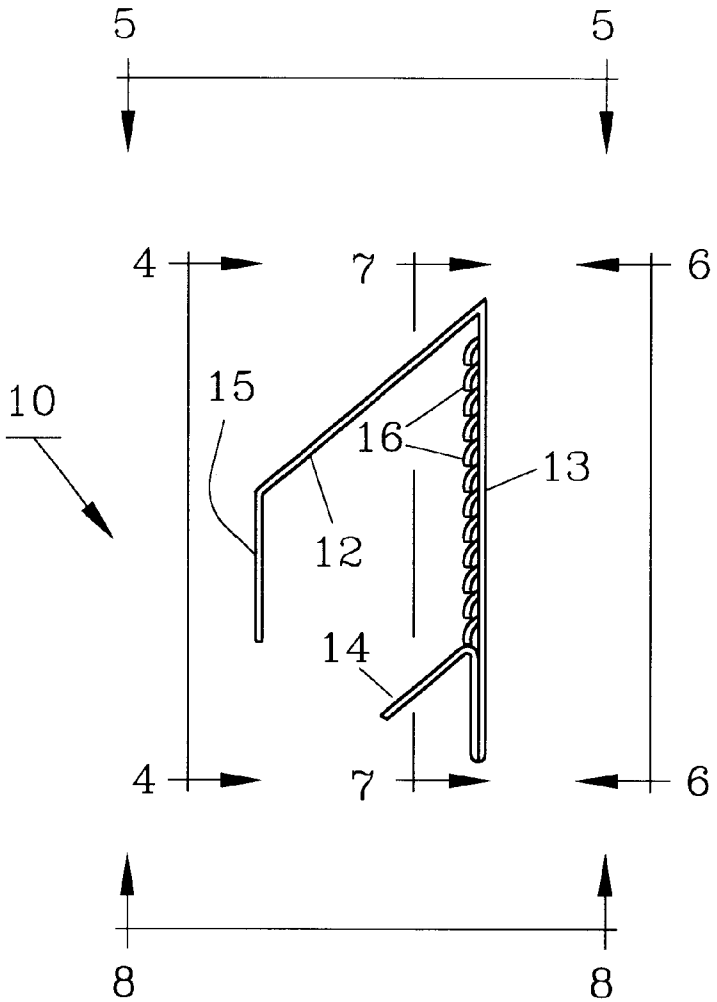
FIG. 3 illustrates an end view of a louver member as shown in FIGS. 1 and 2.
Figure 6:
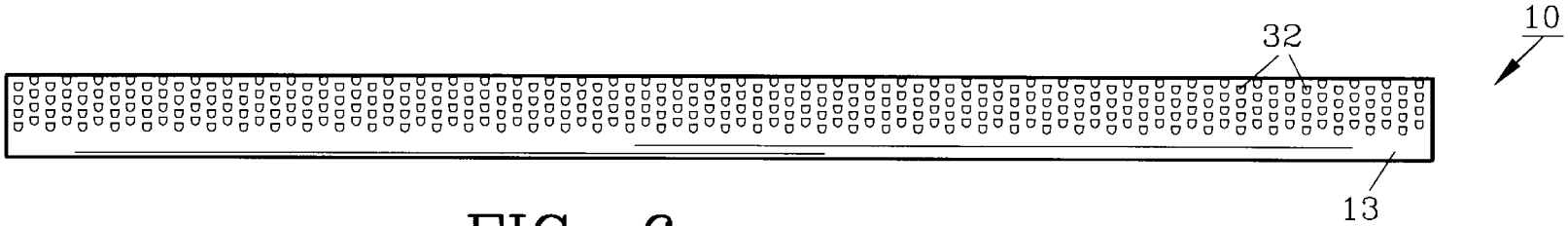
FIG. 6 pictures a rear view of the louver member as shown in FIG. 3 along the lines 6—6.
Figure 7:
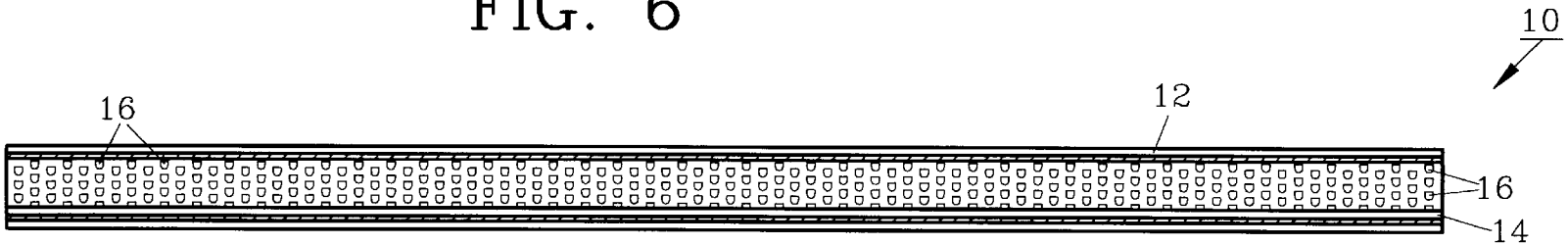
FIG. 7 demonstrates a partial front view of the louver member as shown in FIG. 3 along lines 7—7.
Figure 7A:
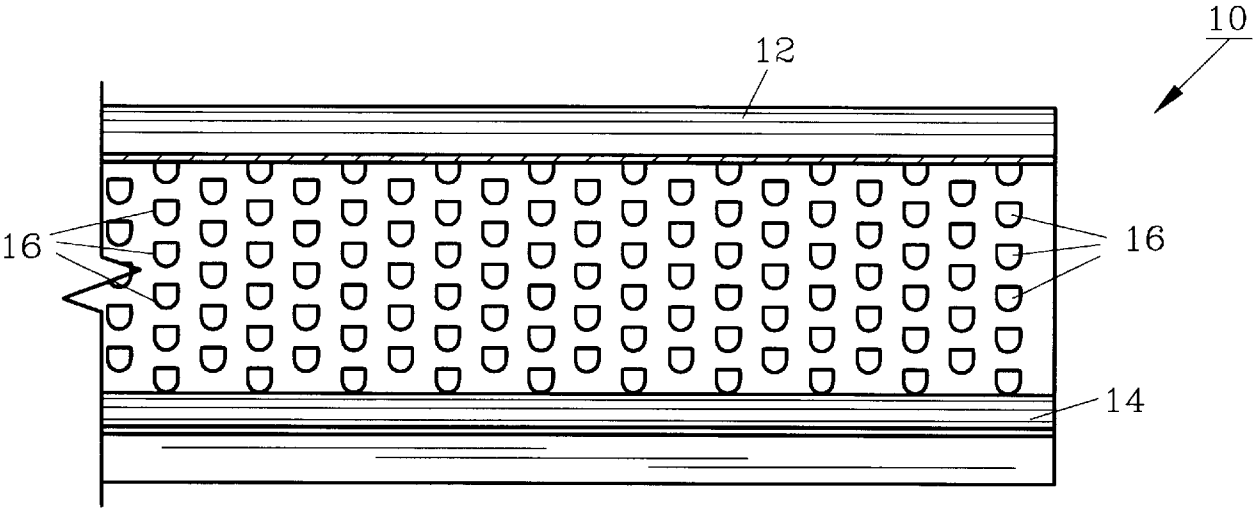
FIG. 7A illustrates an enlarged fragmented view of the partial front view shown in FIG. 7.
Figure 4A:
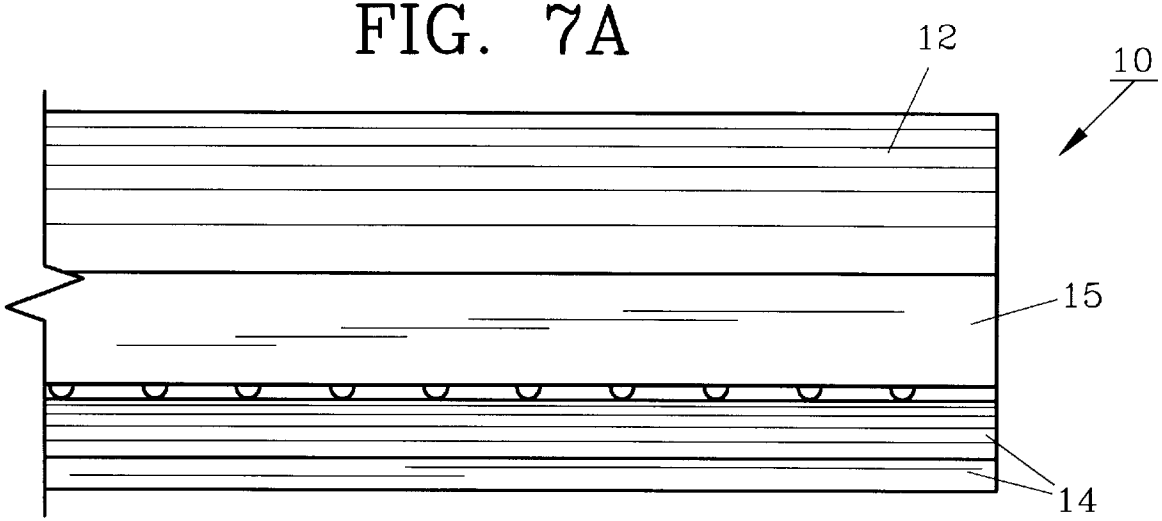
FIG. 4A illustrates an enlarged fragmented view of the front view shown in FIG. 4.
Figure 5A:
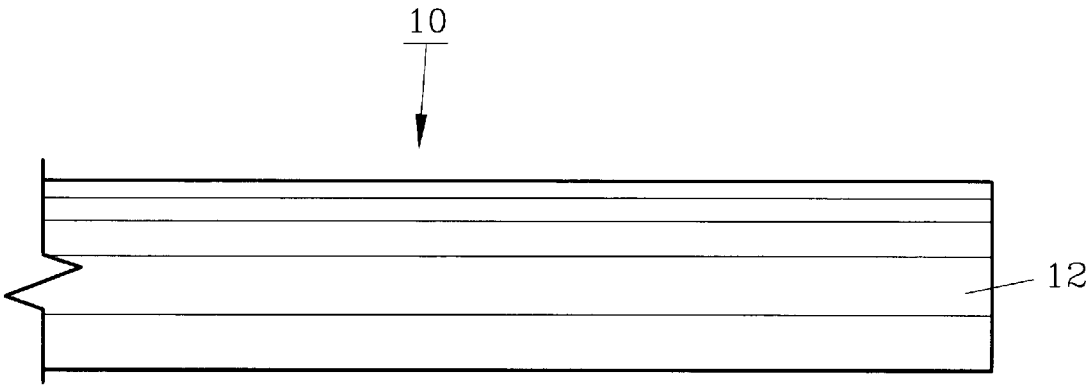
FIG. 5A demonstrates an enlarged fragmented view of the top plan view shown in FIG. 5.
Figure 6A:
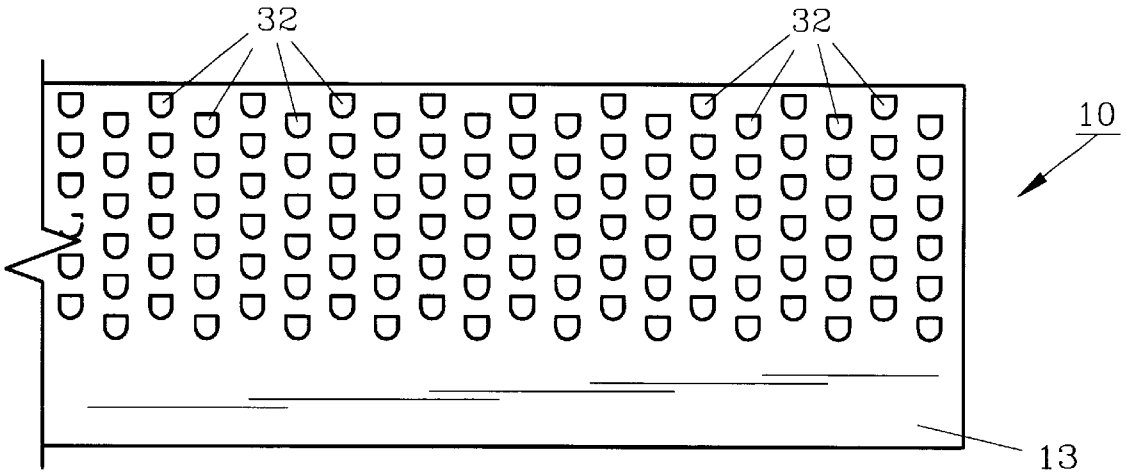
FIG. 6A depicts an enlarged fragmented view of the rear view shown in FIG. 6.
Figure 11A:
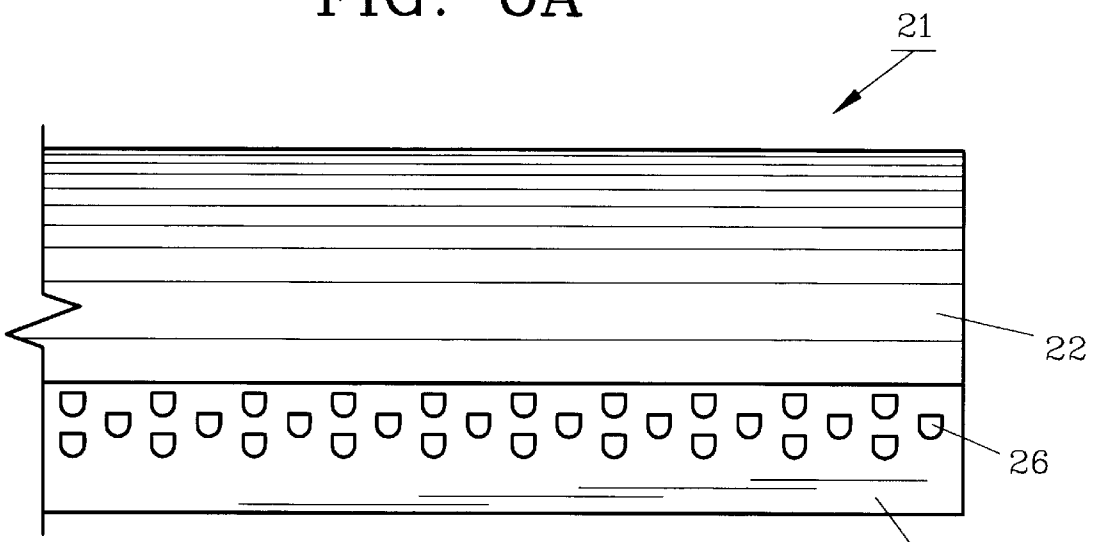
FIG. 11A illustrates an enlarged fragmented view of the front view shown in FIG. 11.

In FIG. 3, the right end of a single louver member 10 is shown with bracket 14 attached to rear section 13 near the bottom thereof and extending outwardly (FIG. 8), in the same direction as front section 12. It should be understood that the left end of louver member 10 is a mirror image of the right end shown in FIG. 3. Bracket 14 acts as a "saddle" during installation as shown in FIG. 2 to allow workmen to easily position adjacent, abutting louver members 10 whereby said louver members 10 are aligned parallel. As also shown in FIG. 6, louver member 10 defines a series of apertures 32 in rear section 13 preferably having a "pocket" configuration which can be formed such as by metal stamping or the like. Front lips 16 (as shown in FIG. 7) are formed during stamping and extend slightly from rear section 13 in a frontal direction. As would be understood, apertures 32 allow air to pass from the exterior, into and out of attic 20 of house 11 as shown in FIG. 1.

Louver members 10 are preferably formed from aluminum, although vinyl (polyvinyl chloride) or wood could be used and can be color coordinated to match particular house trim such as siding 31 shown in FIG. 1 or other door and window trim (not shown) as desired. Louver members 10 are manufactured in conventional lengths as are used in the aluminum siding industry. Preferably, louver members 10 have a length of 12 feet (3.66 m) and height of 4 inches (10.16 cm).

Figure 4:
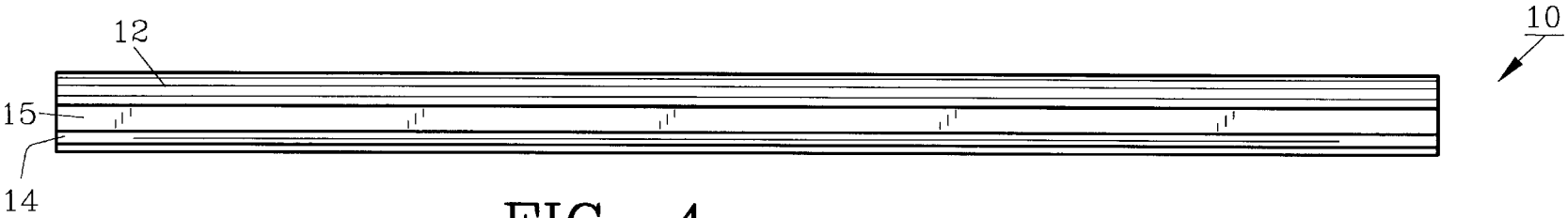
FIG. 4 depicts a front view of the louver member as shown in FIG. 3 along lines 4—4.
Figure 5:
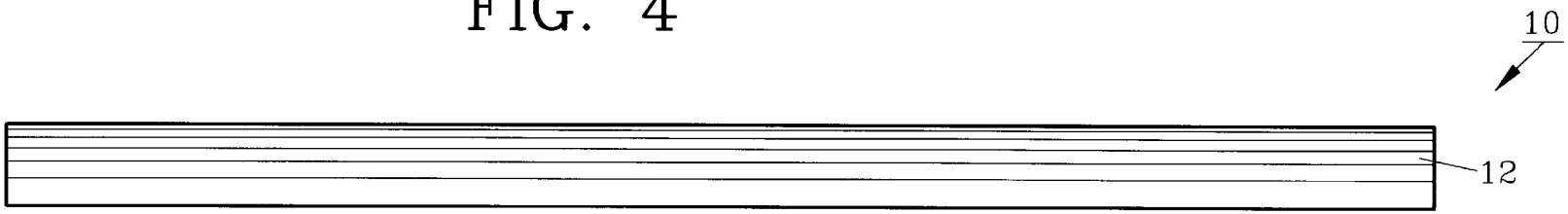
FIG. 5 shows a top plan view of the louver member shown in FIG. 3 along lines 5—5.
Figure 8A:
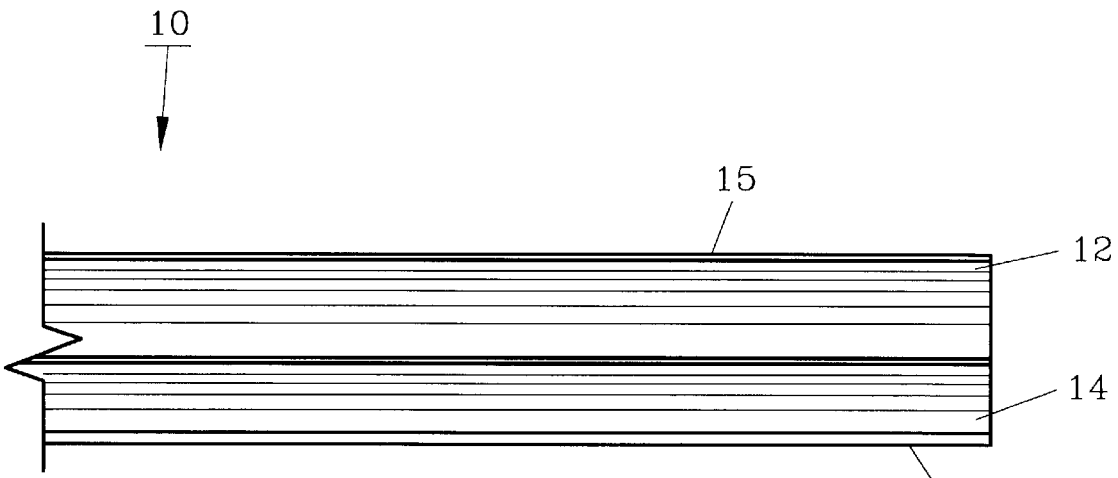
FIG. 8A pictures an enlarged fragmented view of the bottom view of shown in FIG. 8.
Figure 8:
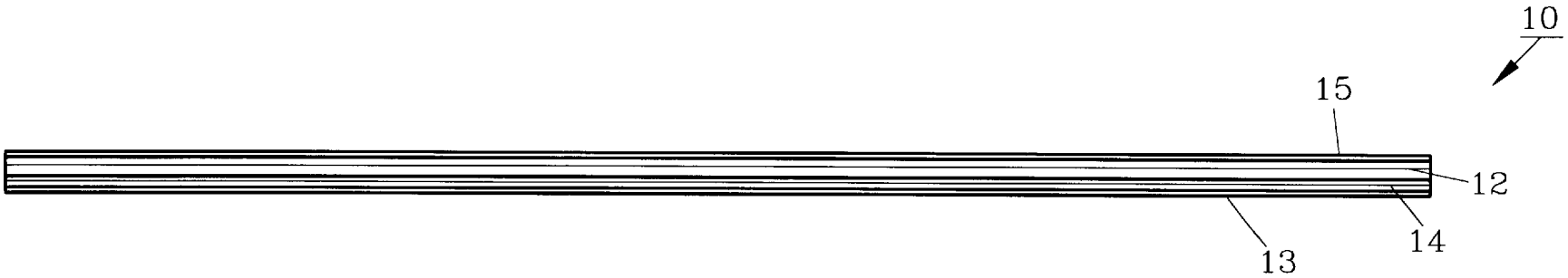
FIG. 8 shows a bottom view of the louver member as shown in FIG. 3 along lines 8—8.

In FIG. 7, a partial front view of preferred louver member 10 is shown cut as along lines 7—7 in FIG. 3 whereas in FIG. 4, a complete frontal view as shown along lines 4—4 in FIG. 3 is seen. FIG. 5 shows a top view along lines 5—5 of FIG. 3 whereas FIG. 8 provides a bottom view thereof. FIGS. 4A, 5A, 6A, 7A and 8A provide enlarged fragmented views of FIGS. 4, 5, 6, 7 and 8, respectively, for clarity purposes.

Figure 9:
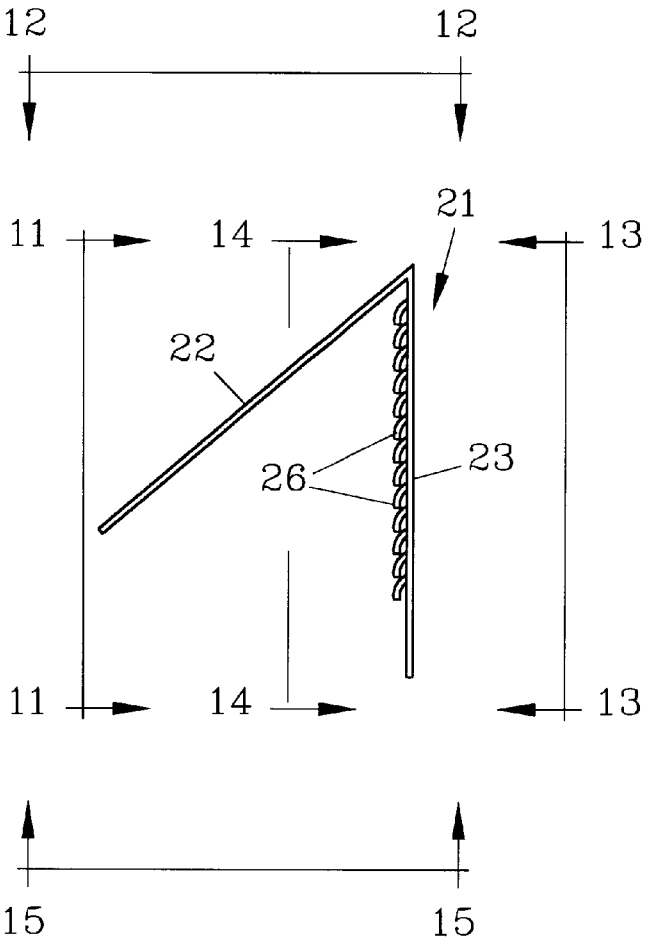
FIG. 9 demonstrates an end view of an alternate embodiment of the louver member.
Figure 10:
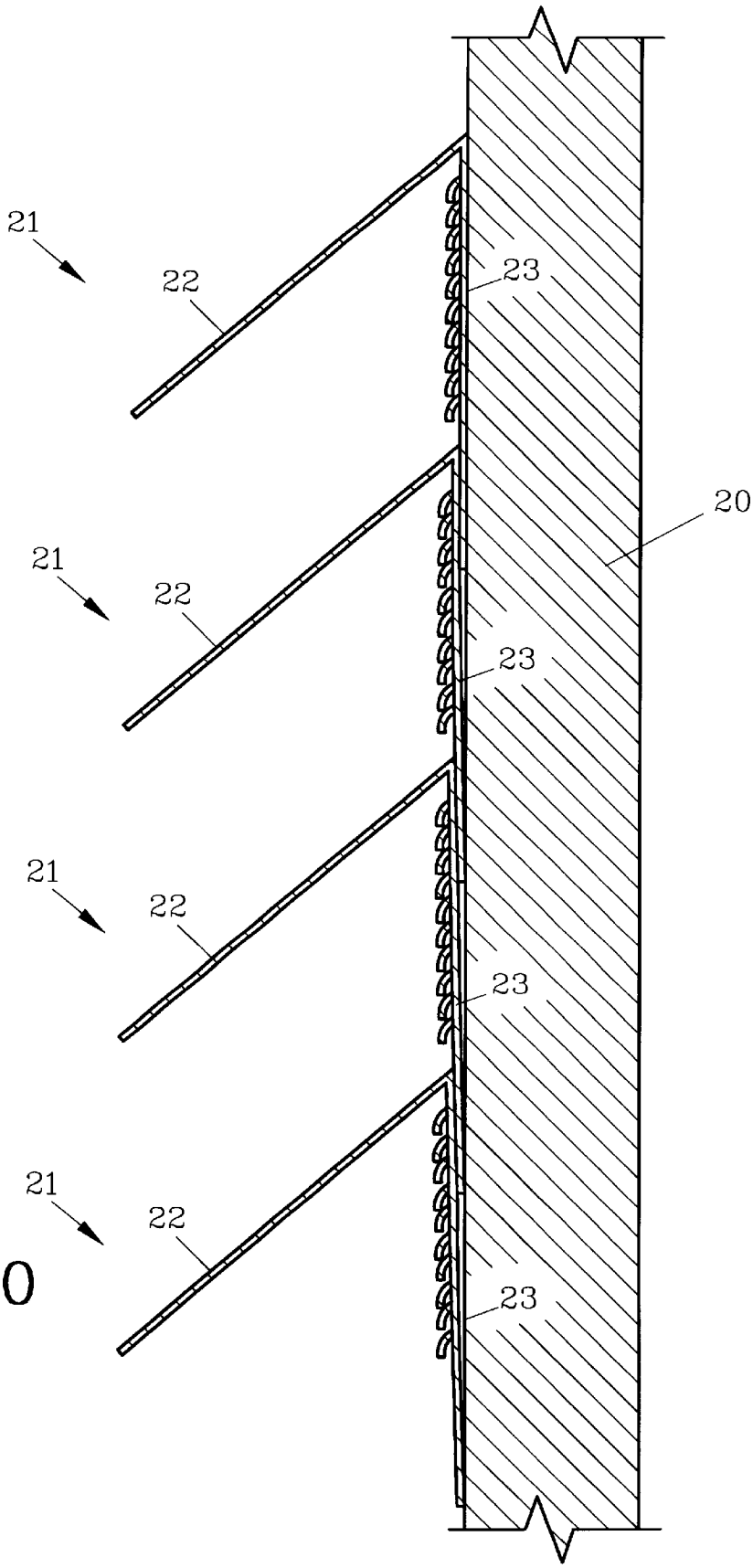
FIG. 10 features a cross-section view of a plurality of the louver members as seen in FIG. 9 forming a louver assembly as in FIG. 1.

A first alternate embodiment of a louver member is shown in FIGS. 9–15 wherein louver member 21 is seen with front section 22 and rear section 23. FIG. 9 depicts a view of the right end of louver member 21, which is a mirror image of the left end. Front section 22 is linear whereas the preferred embodiment as seen in FIG. 3, front section 12 is non-linear. In FIG. 10, louver members 21 are shown attached to roof truss 24. As seen, louver members 21 are slightly overlapped along rear section 23 and are affixed to truss 24 such as by screws, nails or other conventional fasteners (not shown) as hereinbefore described regarding preferred louver member 10. Air openings 25 are formed in louver member 21 as in preferred louver member 10 by metal stamping or other conventional means. Louver member 21 is less expensive to manufacture due to its simple shape than preferred louver member 10.

Figure 15:
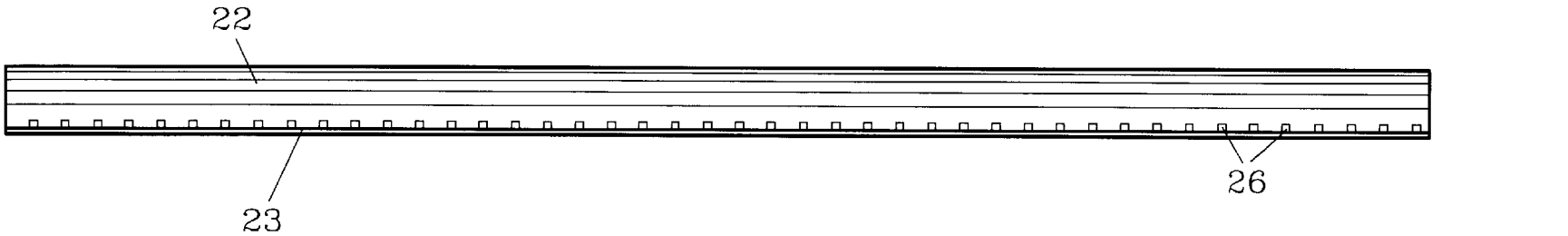
FIG. 15 pictures a bottom view of the louver member as shown in FIG. 9 along lines 15—15.
Figure 11:
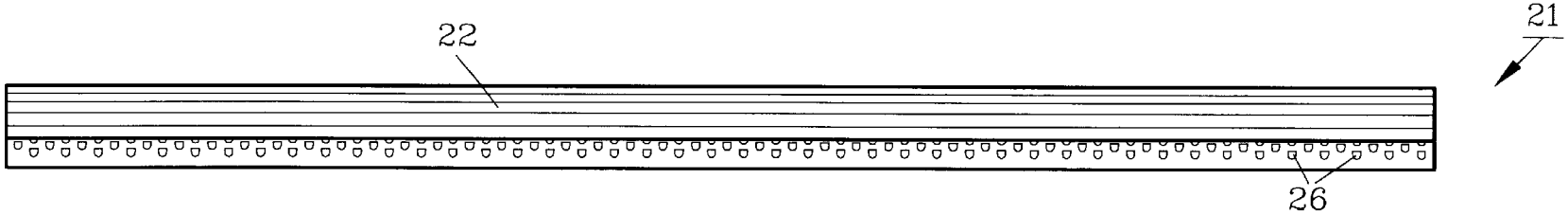
FIG. 11 depicts a front view of the louver member along lines 11—11 as seen in FIG. 9.
Figure 12:
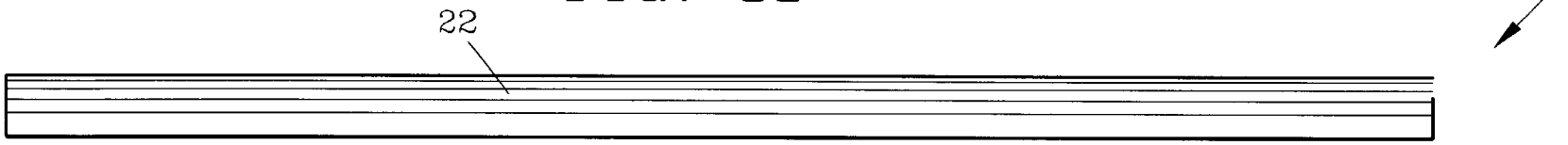
FIG. 12 shows a top view of the louver member as seen in FIG. 9 along lines 12—12.
Figure 13:
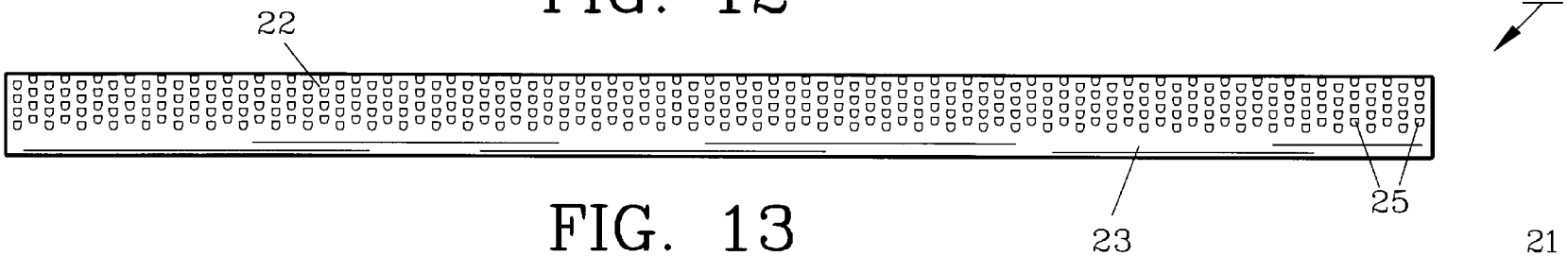
FIG. 13 demonstrates a rear view of the louver member as shown in FIG. 9 along lines 13—13.
Figure 14:
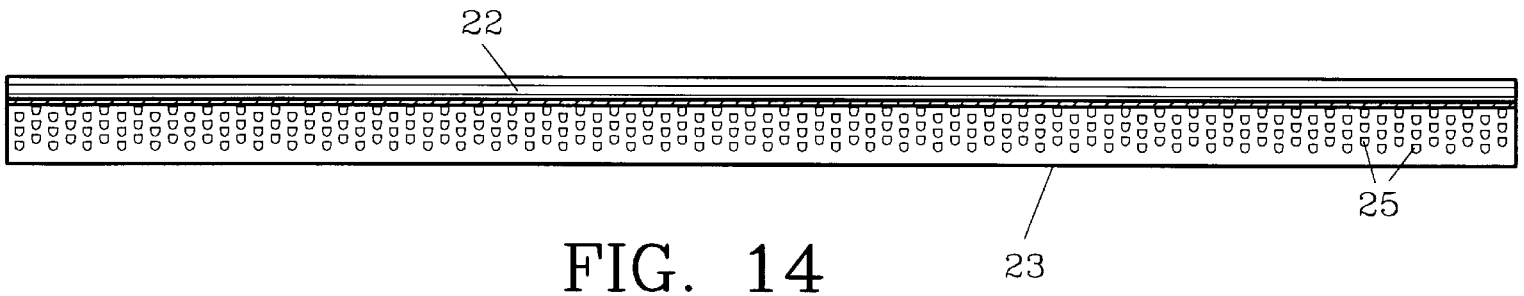
FIG. 14 illustrates a fragmented front view of the louver member as shown in FIG. 9 along lines 14—14.
Figure 12A:
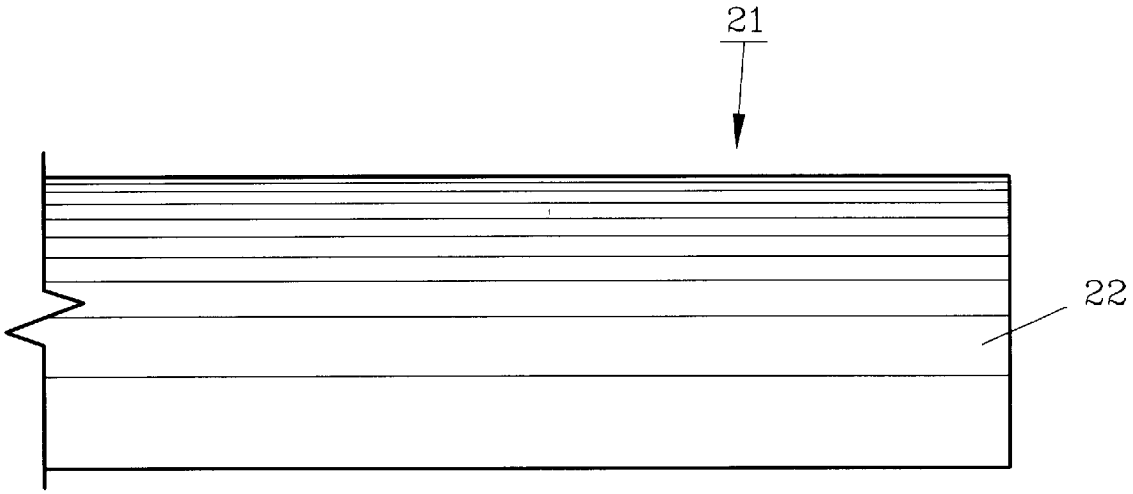
FIG. 12A pictures an enlarged fragmented view of the top view shown in FIG. 12.
Figure 15A:
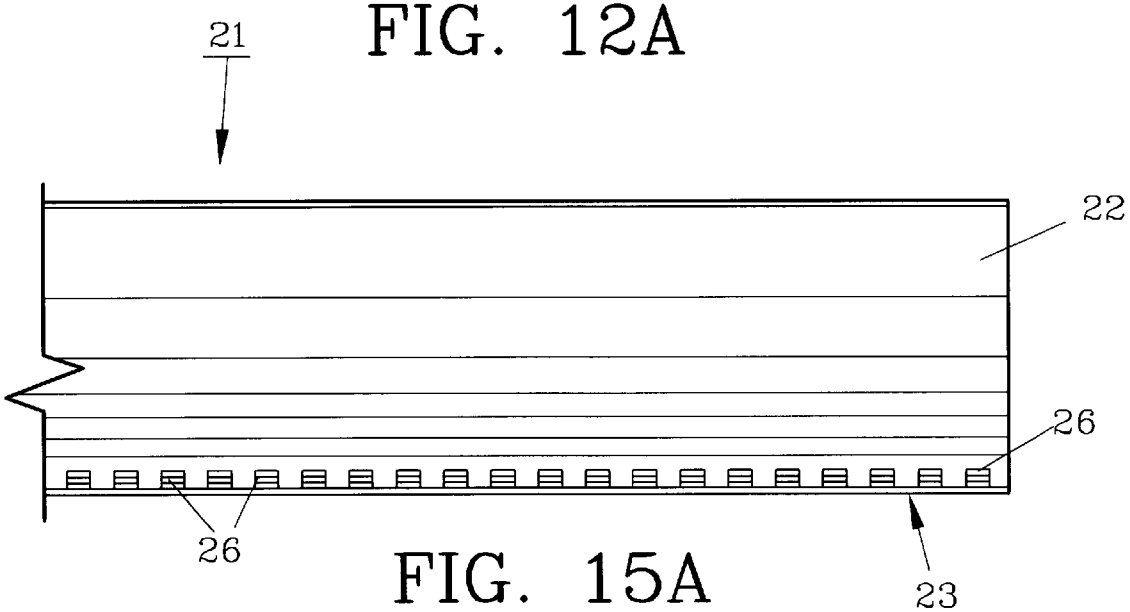
FIG. 15A depicts an enlarged fragmented view of the bottom view of shown in FIG. 15.
Figure 14A:
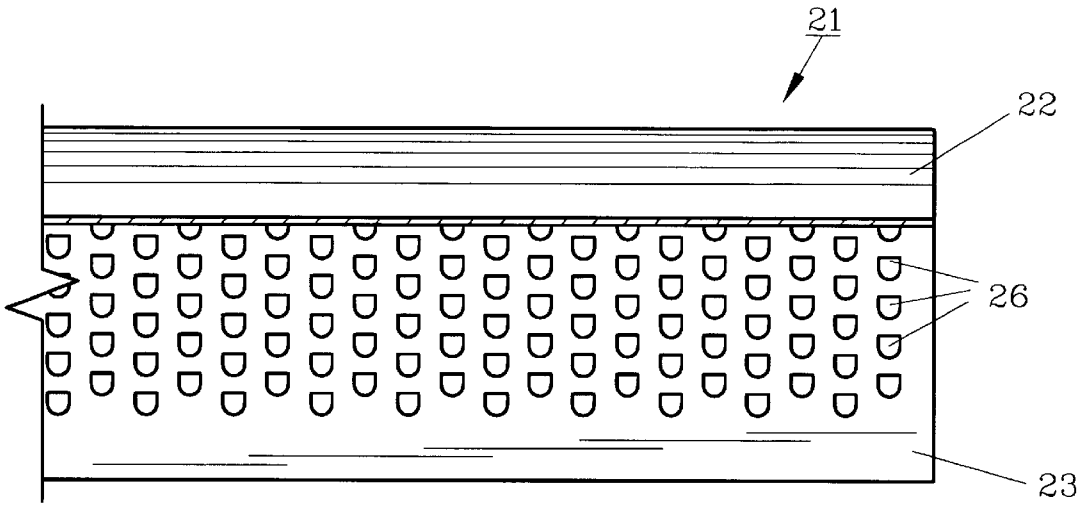
FIG. 14A demonstrates an enlarged fragmented view of the fragmented front view shown in FIG. 14.
Figure 13A:
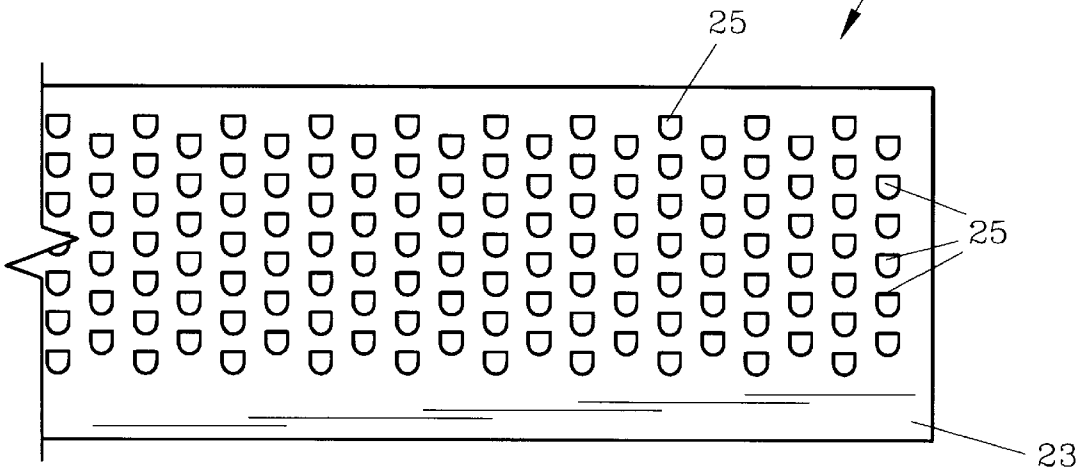
FIG. 13A depicts an enlarged fragmented view of the rear view shown in FIG. 13.

In FIG. 11, as shown along lines 11—11 in FIG. 9, openings 25 are provided with a front lip 26 as also seen in FIG. 14. Rear section 23 as shown in FIG. 13 demonstrates a particular pattern for openings 25 although other patterns and openings may also be utilized, depending on the particular air transfer amount or opening desired. FIG. 12 provides a top view of louver member 21 whereas FIG. 15 provides a bottom view of alternate louver member 21, both as seen in FIG. 9. FIGS. 11A, 12A, 13A, 14A and 15A show an enlarged fragmented view of FIGS. 11, 12, 13, 14 and 15, respectively, for clarity purposes.

The preferred method of applying louver member 10 or louver member 21 to form a louver assembly includes the step of selecting a particular louver member to be utilized and then cutting the member to the desired longest or bottom length as shown in FIG. 1. Next, a second louver member is then cut to the required length to form the next "step" in the triangular shaped louver assembly such as louver assembly 30 as shown in FIG. 1. Once the first cut louvered member is properly attached such as by nails or other fasteners to a roof truss such as truss 24 as shown in FIG. 2, a next or shorter louver member is cut and is then aligned therewith and affixed to the louver member as shown in FIG. 2. Succeeding louver members are cut to the proper length such as with the use of manual tin snips and are likewise affixed to the supporting roof trusses and abutted to the prior louver member until the louver assembly such as triangle-shaped louver assembly 30 is completed and properly installed. When completed, the louver assembly appears unitary and the air openings are substantially concealed from view making the appearance of the building more aesthetically pleasing than with conventional open, slat type louvers.

Figure 16:
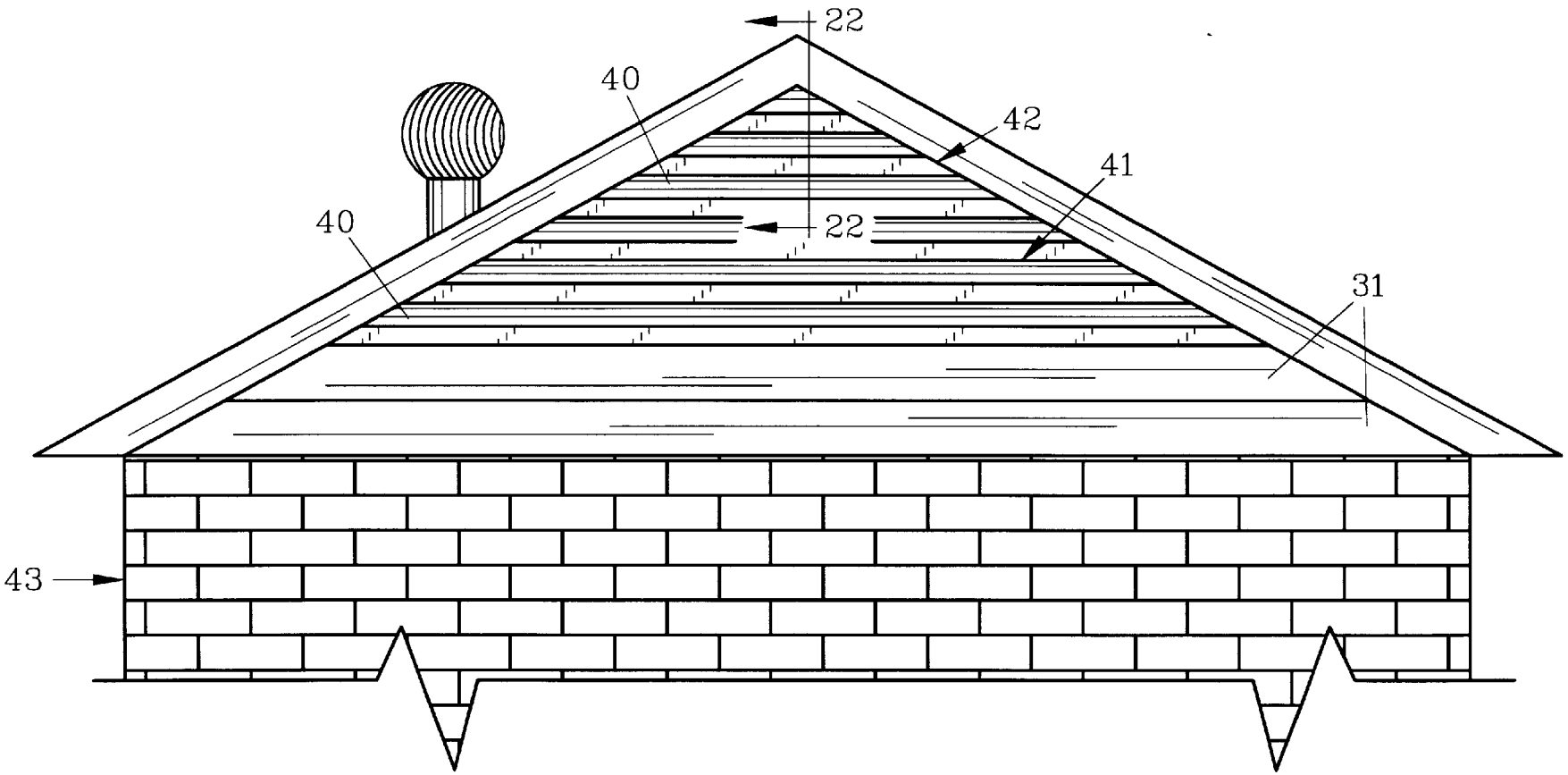
FIG. 16 shows the end of a house with another embodiment of the louver assembly of the invention.
Figure 17:
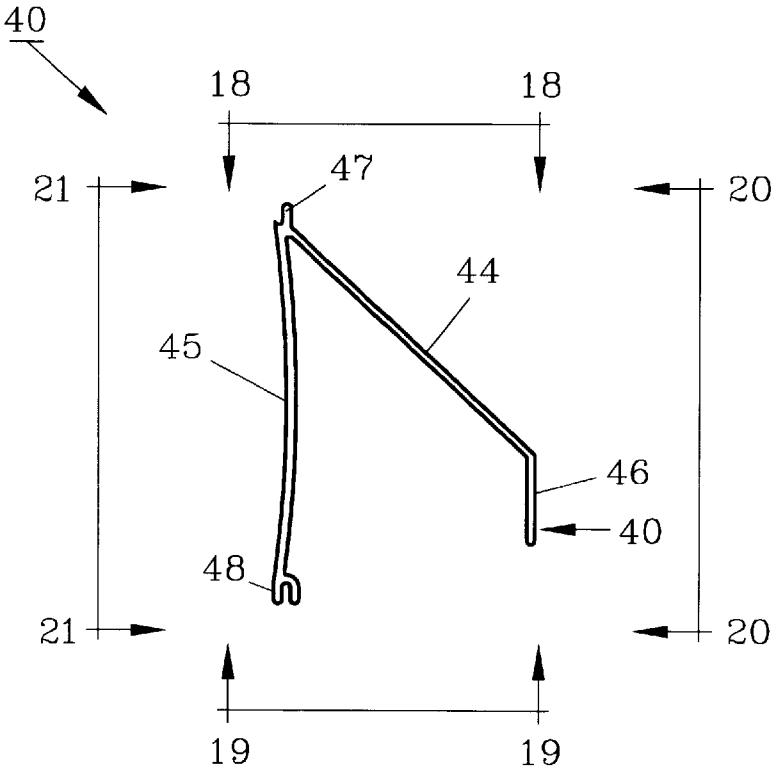
FIG. 17 demonstrates an end view of a louver member of the louver assembly shown in FIG. 16.
Figure 18:
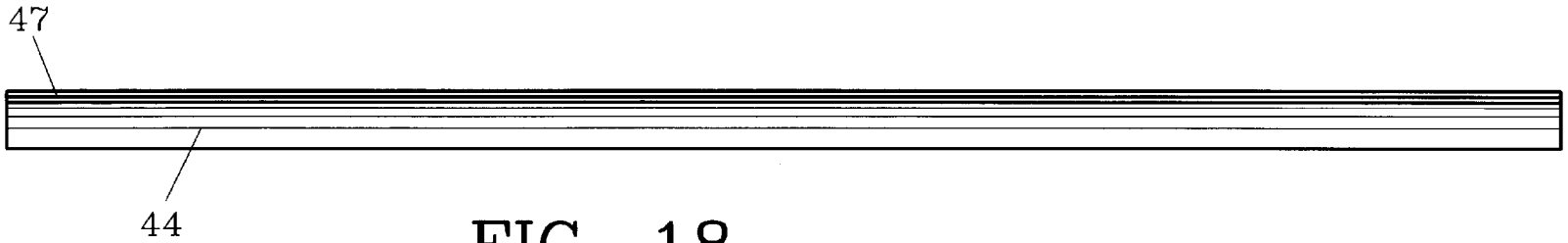
FIG. 18 depicts a top plan view of the louver member as shown in FIG. 17 along lines 18—18.
Figure 19:
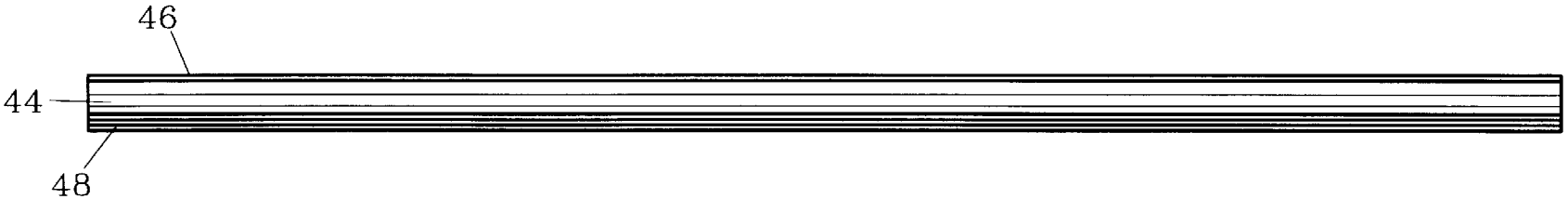
FIG. 19 demonstrates a bottom view of the louver member as shown in FIG. 17 along lines 19—19.
Figure 18A:
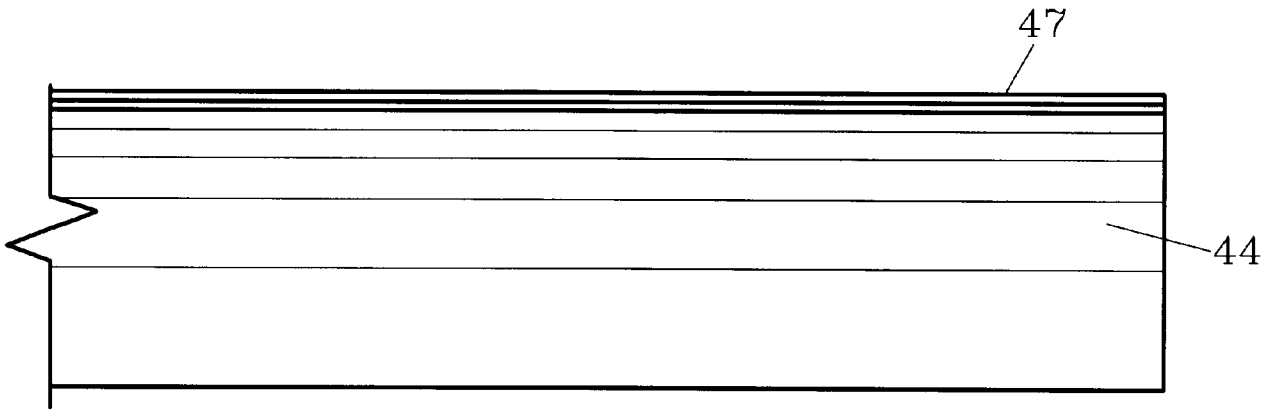
FIG. 18A illustrates an enlarged fragmented view of the top plan view shown in FIG. 18.
Figure 19A:
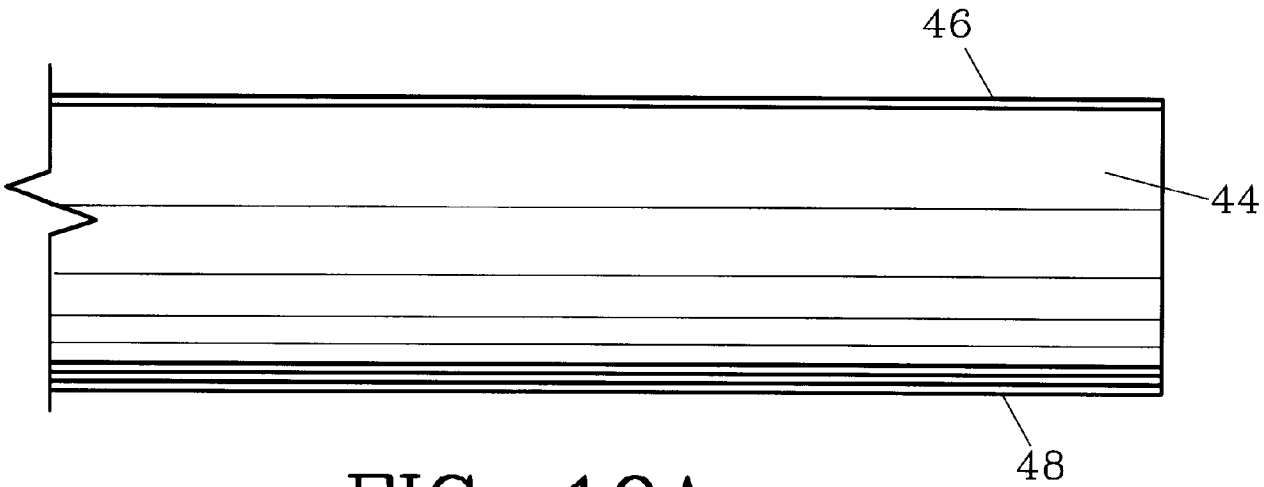
FIG. 19A shows an enlarged fragmented view of the bottom view shown in FIG. 19.
Figure 20A:
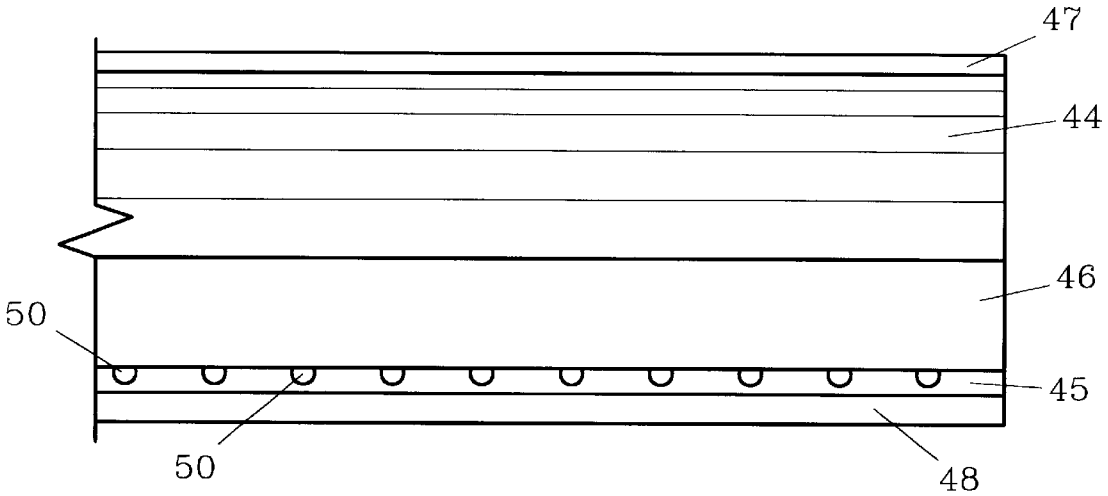
FIG. 20A illustrates an enlarged fragmented view of the front view shown in FIG. 20.
Figure 21A:
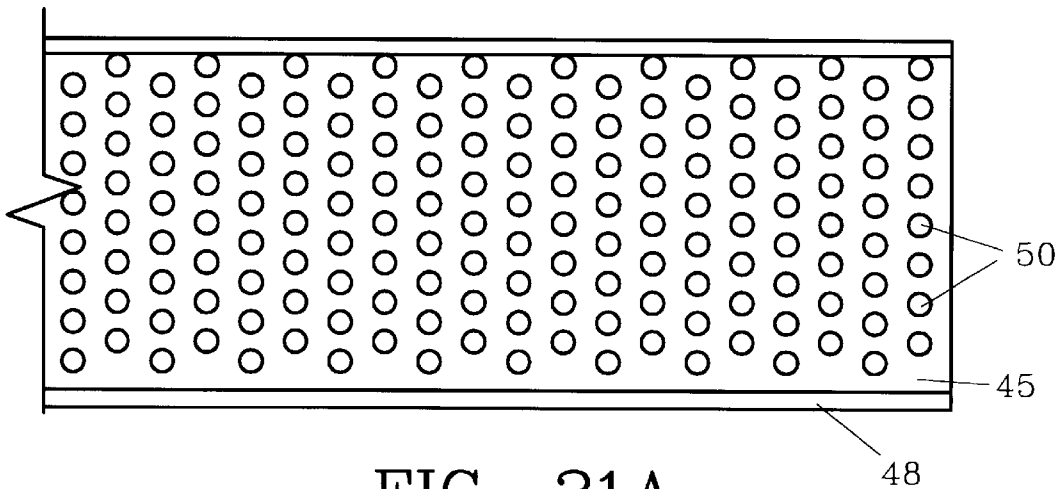
FIG. 21A demonstrates an enlarged fragmented view of the rear view shown in FIG. 21.
Figure 22:
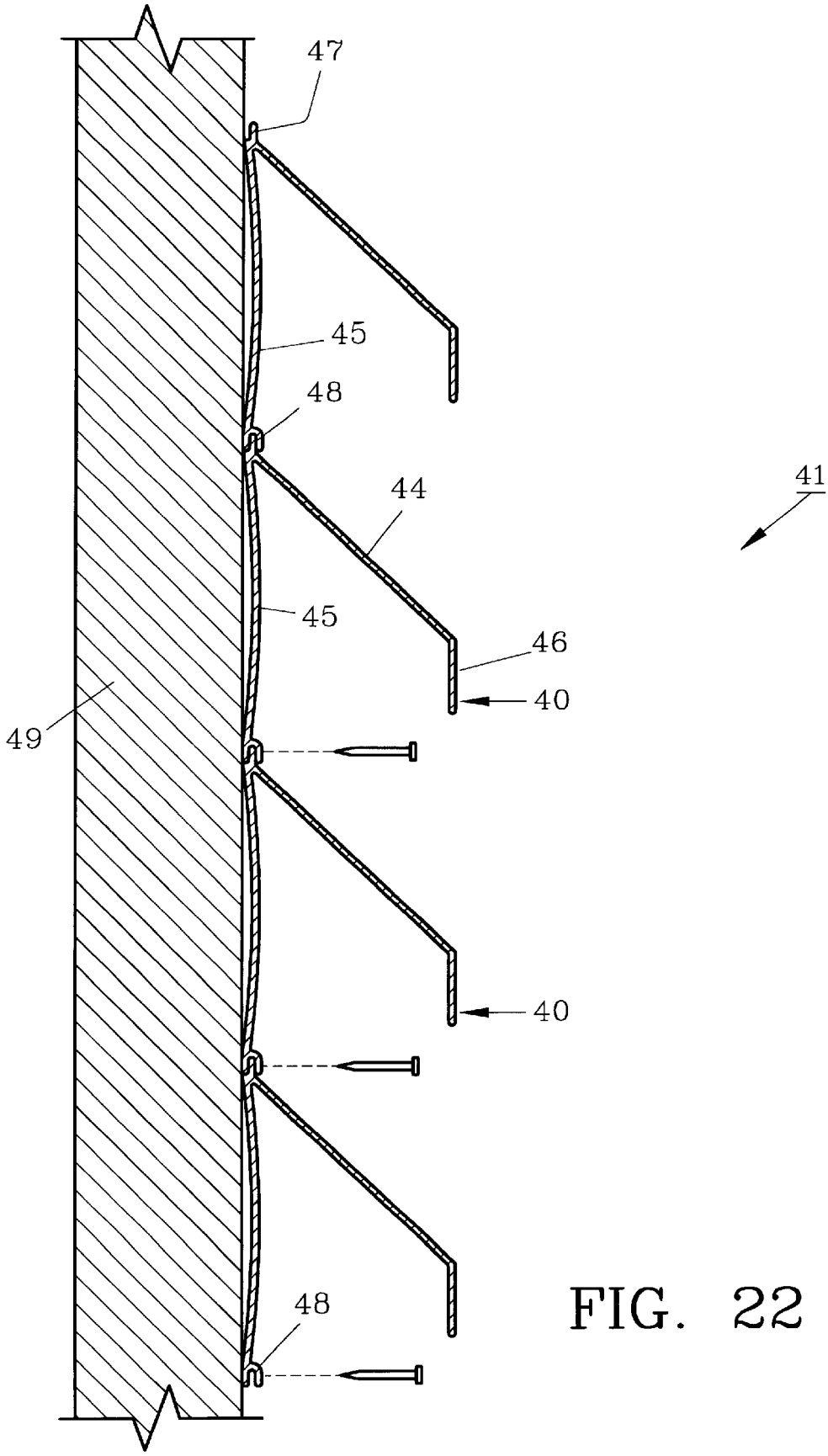
FIG. 22 illustrates a fragmented cross-section view along lines 17—17 of the louver assembly as seen in FIG. 16.

FIG. 16 demonstrates another embodiment of the invention, showing louver members 40 attached to form louver assembly 41 on the end of attic 42 of house 43 with siding 31. FIG. 17 depicts the left end of a louver member 40, showing louver member 40 having a general inverted V-shape with an elongated front section 44 and an elongated rear section 45 integrally formed such as by conventional extrusion or molding processes. It should be understood that the left end of louver member 40 (as shown in FIG. 17) is a mirror image to the right end. Rear section 45 is affixed vertically to roof truss member 49 (as seen in FIG. 22) and preferably has an arcuate shape, which facilitates the flow of air. Front section 44 is affixed to rear section 45 at the top of rear section 45, and depends downwardly to form an acute angle with rear section 45. Front section 44 preferably comprises a bent or downwardly directed portion 46 near the distal end thereof. Preferably portion 46 is approximately one-third the length of section 44. FIGS. 18 and 19 show top and bottom views, respectively, of louver member 40.

As shown in FIG. 17, louver member 40 comprises upper flange 47 protruding somewhat from the top of rear section 45, and catch 48 protruding downwardly from the bottom of rear section 45. Catch 48 preferably has a two-prong shape, such that it defines an opening capable of receiving flange 47 from a second louver member 40, positioned below the first as seen in FIG. 22.

FIG. 22 shows a fragmented cross-sectional view of louver assembly 41, which is identical on both right and left ends of louver assembly 41. The preferred method of forming louver assembly 41 includes the step of attaching rear section 45 of louver member 40 to roof truss member 49 such as by nails, staples, screws or other fasteners. Next, a second louver member is placed below the first louver member such that flange 47 of the second (lower) louver member is inserted into catch 48 of the first (upper) louver member, as seen in FIG. 22. A fastening member is then driven through interlocking flange 47 and catch 48 and into roof truss member 49, thereby affixing the louver members to each other and roof truss member 49.

Figure 20:
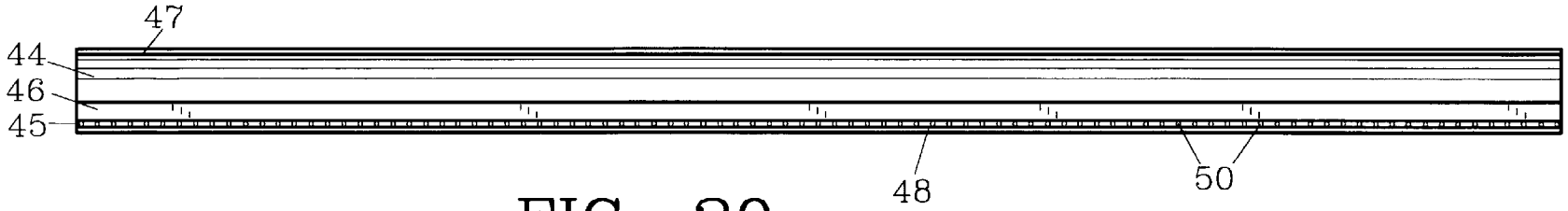
FIG. 20 pictures a front view of the louver member as shown in FIG. 17 along lines 20—20.
Figure 21:
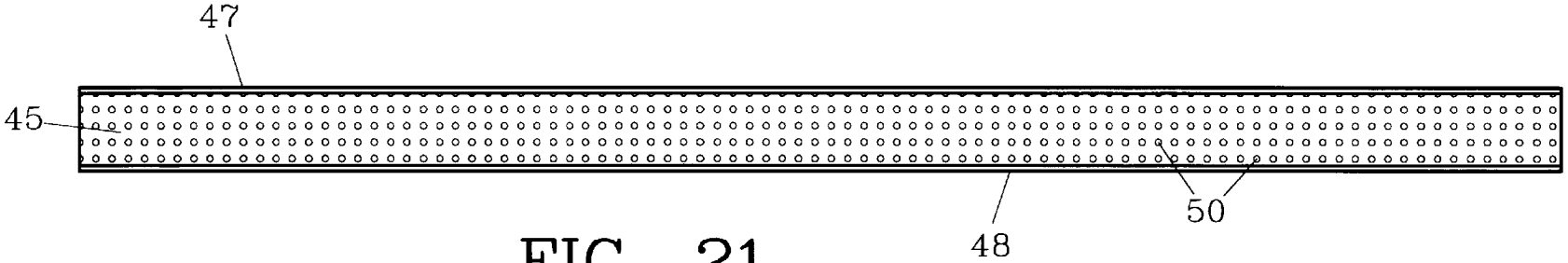
FIG. 21 depicts a rear view of the louver member as shown in FIG. 17 along lines 21—21.

Rear section 45 defines apertures 50 as shown in FIGS. 20 and 21. Apertures 50 allow air to travel into and out of attic 42 of house 43 as shown in FIG. 16. FIGS. 18A, 19A, 20A and 21A show enlarged fragmented views of FIGS. 18, 19, 20 and 21, respectively, for clarity purposes.

Figure 23:
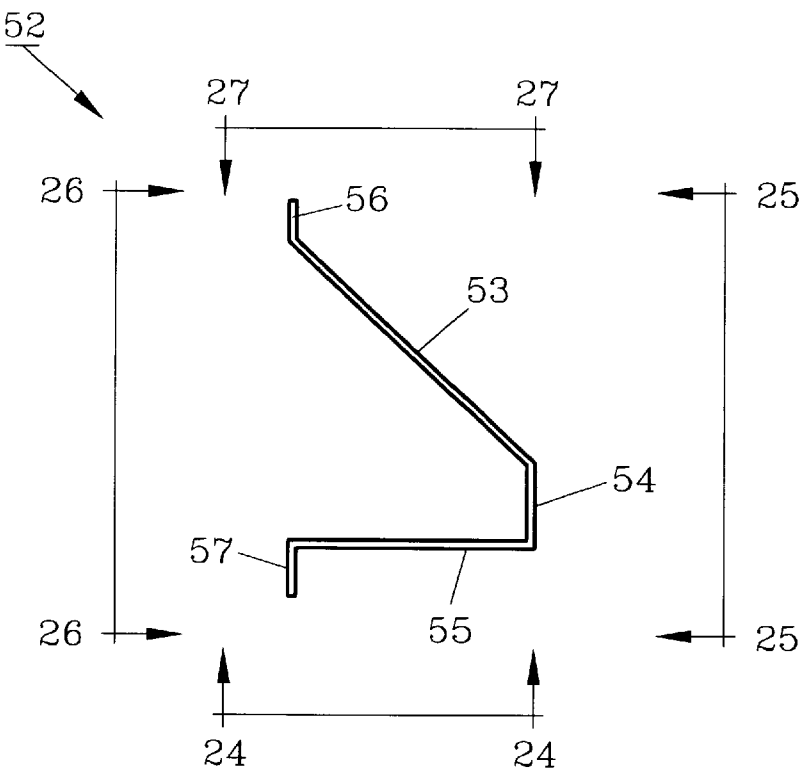
FIG. 23 shows an end view of yet another embodiment of the louver member.
Figure 28:
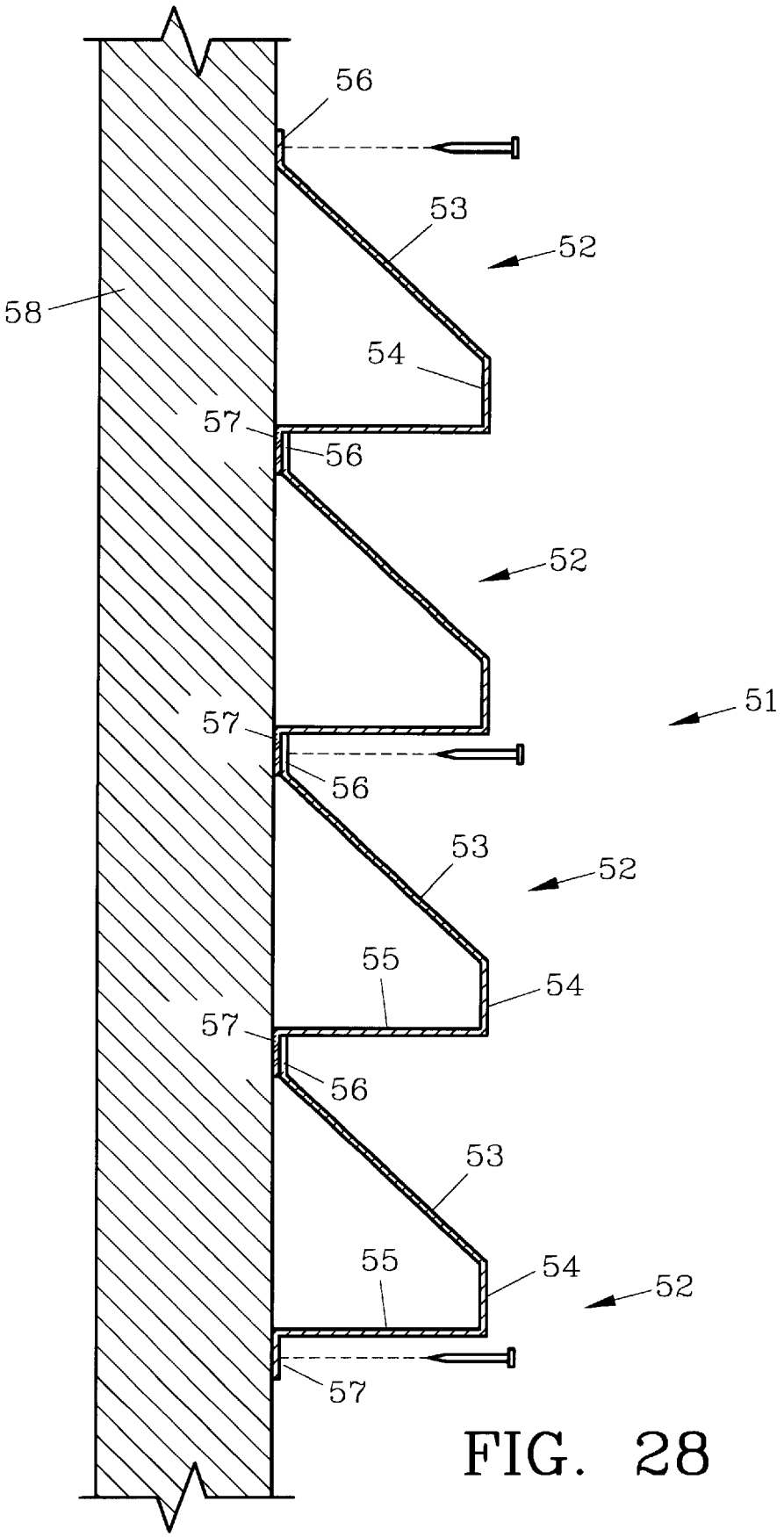
FIG. 28 shows a cross sectional view of yet another embodiment of the louver members of the invention as mounted on a building support.

FIG. 23 depicts the left end of yet another embodiment of the invention, it being understood that the left end of louver member 52 is a mirror image to the right end. FIG. 28 illustrates a cross-sectional view of louver assembly 51, which is identical to both the left and right ends of louver assembly 51. Preferably, louver member 52 includes an elongated top section 53 depending downwardly from roof truss member 58 to form an acute angle therewith. Top section 53 connects to middle section 54 to form an obtuse angle therewith. Middle section 54 is approximately one-third the length of top section 53, and depends downwardly such that it is parallel with roof truss member 58. Middle section 54 connects with a bottom section 55 to form a right angle therewith. Bottom section 55 extends back to roof truss member 58 such that it is perpendicular to roof truss member 58 and forms a right angle therewith.

As seen in FIG. 28, louver members 52 preferably have flanges 56 extending upward from top section 53 such that flange 56 is parallel with roof truss member 58. Louver members 52 have an additional flange 57 extending downwardly from bottom section 55 parallel to roof truss member 58 and perpendicular to bottom section 55.

The preferred method of forming louver assembly 51 includes the step of attaching louver member 52 to roof truss member 58 by inserting nails, staples, screws or other fastening members through flange 56 into roof truss member 58. Next, a second louver member 52 is placed below first louver member 52 such that flange 56 of second (lower) louver member 52 overlaps flange 57 of the first (upper) louver member 52 (as shown in FIG. 22). A fastening member is then driven through the overlapping flanges and into roof truss member 58 so that louver members 52 are attached to each other and the roof truss member.

Figure 24:
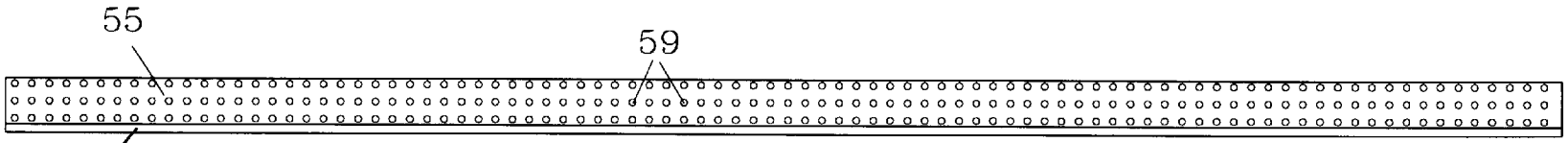
FIG. 24 pictures a bottom view of the louver member as shown in FIG. 23 along lines 24—24.
Figure 27:
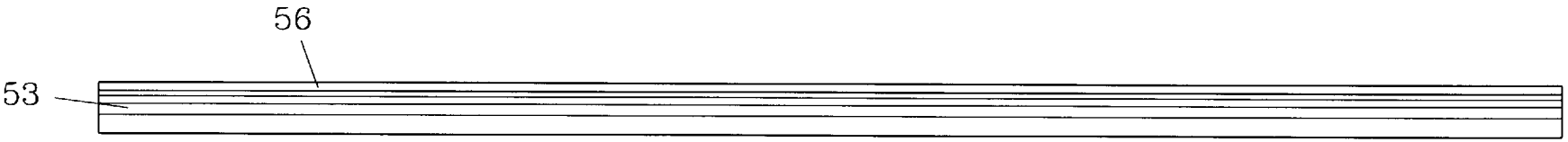
FIG. 27 pictures a top plan view of the louver member as shown in FIG. 23 along lines 27—27.
Figure 25:
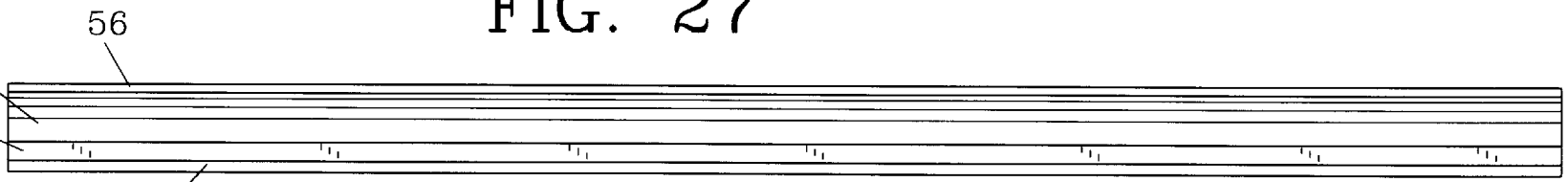
FIG. 25 features a front view of the louver member as shown in FIG. along lines 25—25.
Figure 26:
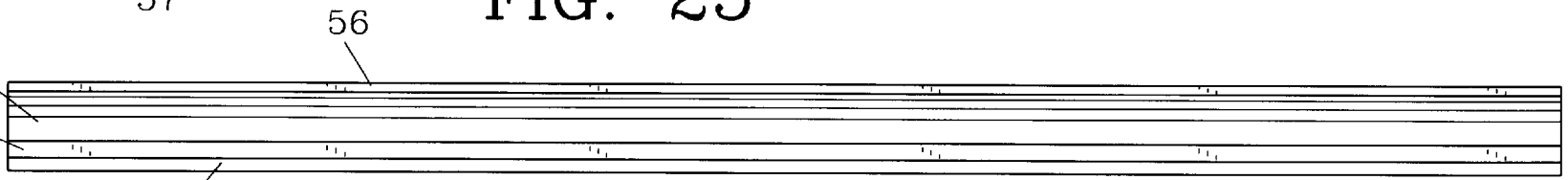
FIG. 26 shows a rear view of the louver member as shown in FIG. 23 along lines 26—26.
Figure 24A:
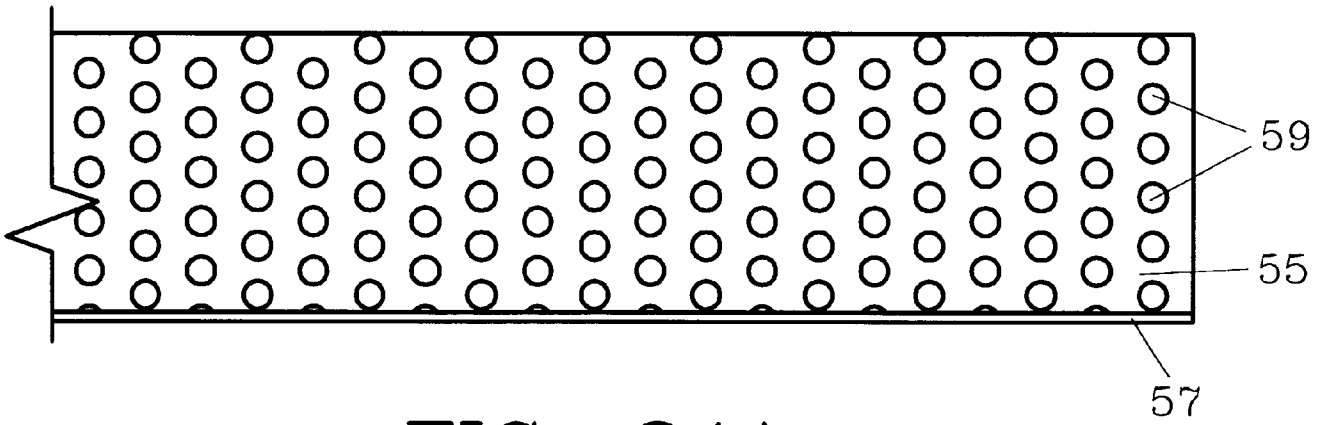
FIG. 24A demonstrates an enlarged fragmented view of the bottom view shown in FIG. 24.
Figure 25A:
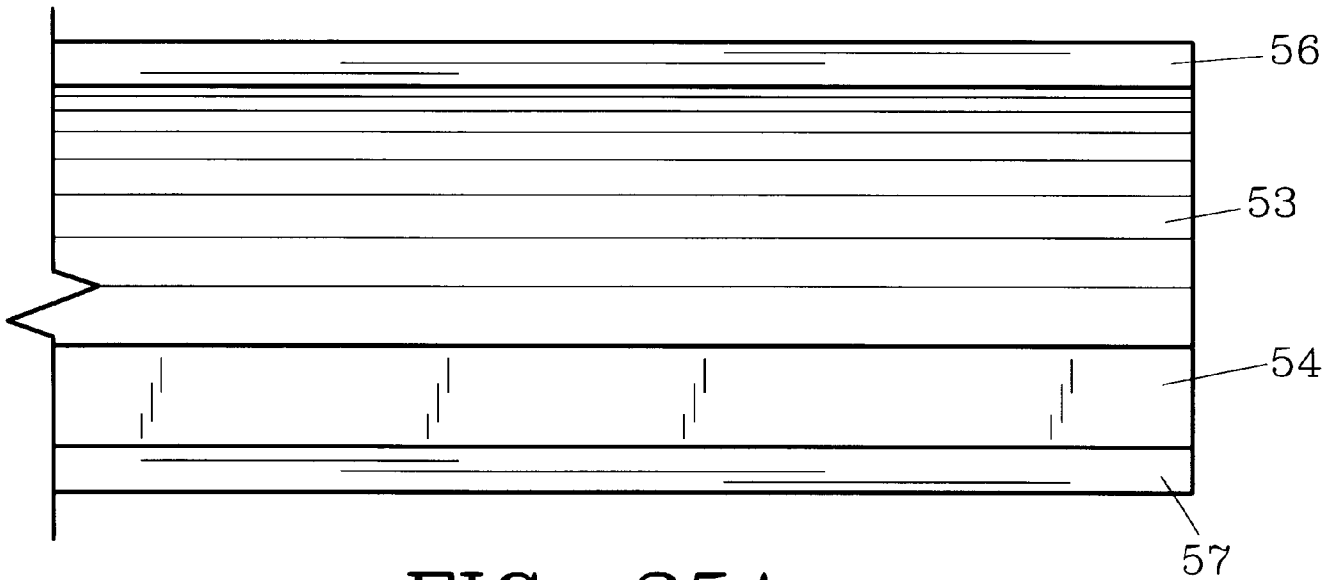
FIG. 25A illustrates an enlarged fragmented view of the front view shown in FIG. 25.
Figure 27A:
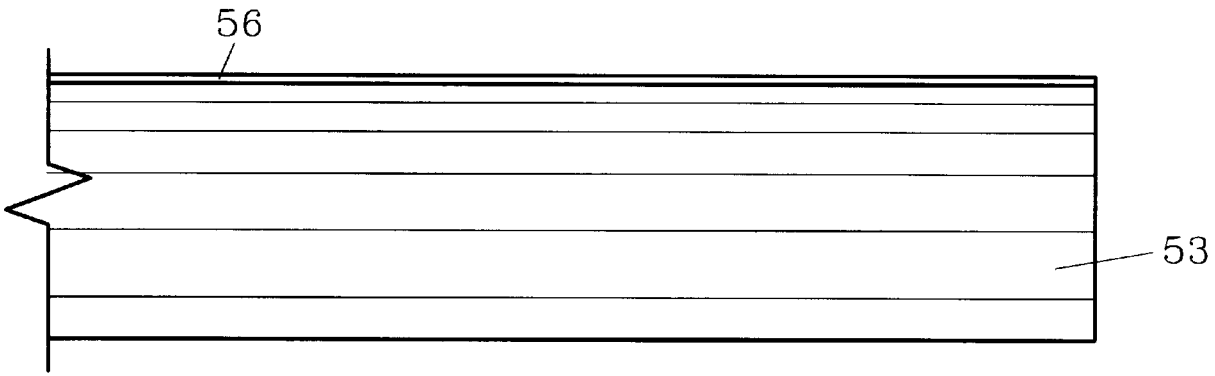
FIG. 27A demonstrates an enlarged fragmented view of the top plan view shown in FIG. 27.
Figure 26A:
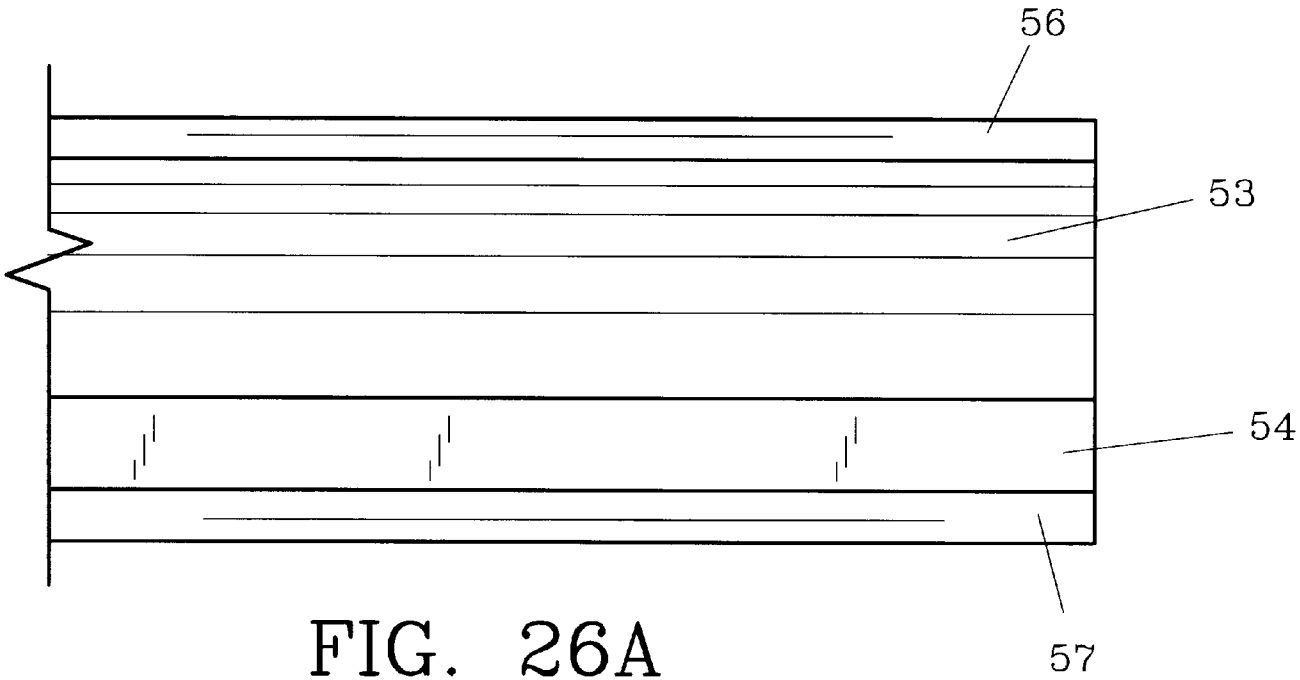
FIG. 26A depicts an enlarged fragmented view of the rear view shown in FIG. 26.

FIG. 24 shows apertures 59 defined by bottom section 55 of louver member 52 (as along lines 24—24 in FIG. 23). Apertures 55 allow for the flow of air into and out of the attic. FIGS. 25 and 26 depict front and rear views, respectively, of louver member 52. FIG. 27 illustrates a top plan view of louver member 52. FIGS. 24A, 25A, 26A and 27A show enlarged fragmented views of FIGS. 24, 25, 26 and 27, respectively, for clarity.

The illustrations and examples provided herein are for explanatory purposes and are not intended to limit the scope of the appended claims.

I claim:

1. A louver member comprising: an elongated top section and an elongated bottom section, a middle section, said middle section integrally formed with said top and said bottom sections, a pair of vertical flanges, one of said pair of flanges attached to said top section and the other of said flanges attached to said bottom section in opposing relation, said bottom section forming a right angle with said middle section, and said bottom section defining a plurality of apertures for air passage.

2. The louver member of claim 1 formed from aluminum.

3. The louver member of claim 1 formed from a polymeric material.

4. The louver member of claim 1 wherein said elongated top section is continuous.

5. The louver member of claim 1 wherein said middle section is integrally formed with said bottom member at the extreme lower end of said middle section.

6. The louver member of claim 5 wherein said top and said bottom flanges are linear.

7. A method of forming a louver assembly using louvers integrally formed with top, middle and bottom sections, said bottom section defining a plurality of apertures comprising the steps of:

a) attaching a first louver member having a top flange to a vertical support; and b) attaching a second louver member having a top flange and a bottom flange to said vertical support by overlapping the bottom flange of the first louver members with the top flange of the second louver member.

8. The method of claim 7 wherein attaching said first and second louver members to said vertical support comprises the step of inserting fastening members through said flanges into said vertical support.

* * * * *